US008123028B2

(12) United States Patent
Doniga

(10) Patent No.: US 8,123,028 B2
(45) Date of Patent: Feb. 28, 2012

(54) CONTACT LENS STORAGE AND CLEANING CASE

(76) Inventor: Cornelius Doniga, Mainz (DE)

( * ) Notice: Subject to any disclaimer, the term of this patent is extended or adjusted under 35 U.S.C. 154(b) by 0 days.

(21) Appl. No.: 12/393,826

(22) Filed: Feb. 26, 2009

(65) Prior Publication Data

US 2009/0211925 A1 Aug. 27, 2009

(30) Foreign Application Priority Data

Feb. 27, 2008 (DE) ..... 20 2008 002 794 U

(51) Int. Cl.
*A45C 11/04* (2006.01)

(52) U.S. Cl. ..... 206/5.1; 141/95; 215/230; 215/260; 116/270; 116/272

(58) Field of Classification Search ..... 206/5.1; 134/22.18, 901; 422/28; 141/95; 215/230, 215/260; 116/270, 272
See application file for complete search history.

(56) References Cited

U.S. PATENT DOCUMENTS

| | | | | | |
|---|---|---|---|---|---|
| 3,070,105 | A | * | 12/1962 | Brown | 134/156 |
| 3,089,500 | A | * | 5/1963 | Stalcup | 134/156 |
| 3,091,328 | A | * | 5/1963 | Leonardos | 206/5.1 |
| 3,101,087 | A | * | 8/1963 | Watson | 134/143 |
| 3,343,657 | A | * | 9/1967 | Speshyock | 206/5 |
| 3,344,461 | A | * | 10/1967 | Floor | 15/118 |
| 3,378,020 | A | * | 4/1968 | Grabiel | 134/156 |
| 3,379,200 | A | * | 4/1968 | Pennell | 134/143 |
| 3,460,552 | A | * | 8/1969 | Sturgeon | 134/135 |
| 3,643,672 | A | * | 2/1972 | Brown | 134/143 |
| 3,695,280 | A | * | 10/1972 | Sturgeon | 134/166 R |
| 4,721,124 | A | | 1/1988 | Tuerkheimer et al. | |
| 4,865,186 | A | * | 9/1989 | Gates | 206/5 |
| 4,909,382 | A | * | 3/1990 | Cuppari | 206/5.1 |
| 5,129,999 | A | * | 7/1992 | Holland et al. | 205/701 |
| 5,195,549 | A | * | 3/1993 | Adams | 134/188 |
| 5,365,630 | A | * | 11/1994 | Beckrich | 15/104.92 |
| 5,431,879 | A | * | 7/1995 | Heyl et al. | 422/30 |
| 5,839,457 | A | | 11/1998 | Rijken et al. | |
| 5,857,475 | A | * | 1/1999 | Volk | 134/153 |
| 6,080,361 | A | | 6/2000 | Borovsky | |
| 6,086,823 | A | * | 7/2000 | Bourset | 422/28 |
| 6,868,963 | B2 | * | 3/2005 | Borovsky | 206/5.1 |
| 2005/0087453 | A1 | * | 4/2005 | Mahieu et al. | 206/5.1 |
| 2005/0103649 | A1 | * | 5/2005 | Vulcu et al. | 206/5.1 |
| 2005/0186128 | A1 | * | 8/2005 | Pinchassi Dar et al. | 422/300 |

FOREIGN PATENT DOCUMENTS

| | | | |
|---|---|---|---|
| DE | 4212873 | C1 | 5/1993 |
| DE | 102007001183 | A1 | 8/2008 |
| FR | 2638248 | A1 | 4/1990 |
| FR | 2835751 | A1 | 8/2003 |
| WO | 9320730 | A1 | 10/1993 |

* cited by examiner

*Primary Examiner* — Mickey Yu
*Assistant Examiner* — Jenine Pagan
(74) *Attorney, Agent, or Firm* — Lowe Hauptman Ham & Berner, LLP

(57) ABSTRACT

A contact lens storage and cleaning case is described. The case compromises (a) two contact lens chambers that are closed via a chamber cap for each contact lens; and (b) fluid reservoir and integrated pump. The contact lens chamber can be closed using removable chamber caps each of which has a flexible compressible cavity in whose center is mounted a flexible cap membrane that faces and isolates the chamber. Air can escape from the cavity via an opening in the chamber cap.

11 Claims, 3 Drawing Sheets

Cross section x-x

Detail view A

CONTACT LENS STORAGE AND CLEANING CASE

RELATED APPLICATIONS

The present application is based on, and claims priority from, German Application Number 20 2008 002 794 U1, filed Feb. 27, 2008, the disclosure of which is hereby incorporated by reference herein in its entirety.

The invention relates to a contact lens storage and cleaning case consisting of two contact lens chambers, one for each lens, as well as a cleaning solution reservoir according to the characterizing portion of claim 1.

Contact lenses, which are one of the most commonly used seeing aids in industrialized countries, serve as a substitute for oftentimes unattractive eyeglasses by being placed directly on the cornea, from which they are separated only by a thin film of tear fluid. Contact lenses are also used by individuals who have no sight problems but who wish to change their eye color. Contract lens allow for this as well.

There are various types of contact lenses, including in terms of the material used. The initially popular hard contact lenses were replaced by contact lenses made of a flexible material that retains water and is permeable to air. This soft material, which is considerably more comfortable for the eye than the original harder material, has also greatly increased the amount of time contact lenses can be worn without causing eye inflammation.

Contact lenses are available in daily, monthly or annual versions. Daily contact lenses should only be worn for one day and then disposed of. Monthly contact lenses can be worn for up to 30 days, and one-year contact lenses can be used for up to 12 months. Since daily contact lenses are only worn for one day, they require no care, since a new pair is used each day.

However, the situation is different when it comes to contact lenses that are worn for a longer period. Tear fluid contains not only salt and water, but also a number of other substances that can contaminate contact lenses. Proteins are a particular culprit in this regard in that during the wearing period they are deposited on the lenses, which rest on the cornea. The favorable bacteria nutrient layer provided by such protein layers can induce eye infections (cornea infections and conjunctivitis).

There are basically two types of contact lens care systems: peroxide (two-stage care system based on hydrogen peroxide); and all in one care systems (one-stage care systems).

Two-stage care systems remove protein deposits from contact lenses using hydrogen peroxide, which is split by a chemical reaction in water and oxygen. Direct exposure of the cornea to hydrogen peroxide ($H_2O_2$) induces severe inflammation of the cornea and could even provoke permanent clouding of the cornea.

The one-stage care system contains a number of chemical components that act on the contact lens and do not cause inflammation if they come into direct contact with the eye.

Contact lenses are customarily placed in a contact lens case (generally at bedtime) for storage and care. Although the storage fluid does not disinfect the lenses, it does prevent them from drying out—since in a dry environment the lenses would shrivel up and dry out within a matter of a few hours.

The purpose of the invention described below is to simplify the storage and cleaning of contact lenses by means of an all-in-one care system.

Wearing contact lenses necessitates lens care and cleaning, both to preserve the lenses and for reasons of hygiene. This is also somewhat inconvenient in that the user must carry with them a storage and cleaning case for the contact lenses as well as a fluid dispenser for the cleaning solution. This is particularly burdensome during periods of travel.

Classic contact lens cases have two separate chambers—one for the right lens and the other for the left lens. After the individual lenses are placed in their respective chambers, the chambers are filled with contact lens fluid and are closed via a cover.

Toting around two such cases—one for storage and the other for cleaning—(as well as a contact lens fluid dispenser), which generally differ in form and size, is burdensome but indispensable for the contact lens wearer since the wearer is dependent on these two cases. Moreover, constantly filling the contact lens chambers with solution from a fluid dispenser can result in adventitious fluid wastage owing to the minute size of the chambers, and is burdensome in the long run.

The basic concept of attempting to combine a contact lens storage and cleaning case with a fluid dispenser is already known. In such a device, the fluid is transported from the dispenser to the contact lens storage and cleaning case within said case by, for example, pushing a button. This method would simplify and render less burdensome the contact lens storage and cleaning process for contact lens users, particularly during periods of travel.

Attempts have already been made to combine the fluid container with the contact lens case in such a way that these two elements need not be carried separately and neither component can go astray or be left behind.

US 20050186128 A1 describes such a refillable contact lens storage and cleaning case wherein integrated check valves and casing compression allow for transport of the cleaning solution from the fluid reservoir to the contact lens chambers.

An additional attempt at such a combination can be found in DE 4212873 C1, which describes a number of embodiments of such a device. The main embodiment in this patent is an enclosure that provides two recessed chambers for contact lens storage, plus two additional contact lens chambers, which are connected to a fluid reservoir that is integrated into the enclosure. These two additional contact lens chambers provide a pipette that transports the cleaning solution to the contact lens chambers. This patent's drawings describe an alternative embodiment with an external "filling tap" that springs out of the casing and in effect constitutes an extension of the fluid reservoir. This filling tap, combined with a flexible and compressible part in the fluid reservoir wall, allows contact lens chambers to be filled with fluid by depressing this compressible part of the casing.

In addition, US 006080361 A describes an electric contact lens cleaning machine that provides a bacteria filter.

U.S. Design 390,356 describes a cylindrical structure that provides a contact lens chamber on either end, one for each contact lens. The fluid reservoir, which is apparently located in the center of this structure, is filled by compressing both contact lens chambers.

FR 2 835 751 A1 likewise describes a case with a fluid reservoir and pump button, whereby the pump-induced surge occurs with the chamber covers open and no pressure compensation mechanism is provided for the contact lens chambers.

The drawback of all of the aforementioned approaches is that the pump-induced surge is severely compromised by the back pressure in the closed contact lens chambers. As a result, these devices can be filled with a defined volume of fluid, but only with their chamber covers open.

Another drawback of the aforementioned devices is that the filling procedure remains cumbersome since transporting the relatively small amount of fluid to the chambers requires the user to hold down a pump button, which can easily cause the fluid to spill out of the open contact lens chambers—and in the worst case scenario force the contact lenses themselves out of their chambers. In addition, placing the contact lenses in the contact lens chambers prior to the filling process is not ideal due to the fact that the featherweight lenses are buoyed by the cleaning solution. Hence in order for the lenses to be disinfected they must first be completely wetted.

Hence the known devices only achieve the desired simplification of contact lens storage and cleaning to a limited degree due to the fact that the procedure with opened contact lens chambers must be performed with care and can result in lens fluid wastage.

Against this backdrop, the goal of the present invention is to optimize a device of the type referred to above in such a way that the device is easier to handle, particularly when it comes to filling the contact lens chambers with disinfectant cleaning solution, including when said chambers are closed.

This process is eased by the invention according to claim 1 in that the contact lens chambers with removable chamber caps remain closed, wherein a compressible cavity is provided via a flexible cap membrane that isolates the contact lens chamber.

Once the lenses have been placed in their respective contact lens chambers, the chambers are covered by means of a cap. In order to prevent fluid from leaking out of the contact lens chambers while the device is being carried, the contact lens chambers must be closed in a manner that provides said chambers with a watertight seal. In addition, this seal must remain intact in the wake of the surge-generated pressure in the contact lens chambers. This is achieved via a cavity on the underside of the cap that serves as a compression area and is isolated from the remainder of the lens-containing contact lens chamber by a flexible membrane.

This in turn allows fluid to be pumped into the watertight-sealed contact lens chamber, wherein the resistance engendered by the additional pressure resulting from air pressure in the isolated cavity is greatly reduced. When fluid enters a capped contact lens chamber, the flexible membrane attached to the underside of the cap expands into said cavity.

In an advantageous embodiment of the invention, the cap membrane is tensioned against the contact lens chamber by a resilient mount in the compressible cavity. This in turn allows for regulation, via said mount, of the pressure generated by the surge that is needed to fill the contact lens chambers.

As a result of the foregoing, the-amount of cleaning solution that flows into the contact lens chambers via the pump-induced surge can be precisely regulated—the advantage of this being that only a precisely defined volume of cleaning solution need be used. This in turn will considerably lengthen the service life of a contact lens storage and cleaning case that is pre-filled with a defined volume of cleaning solution, since only the amount of cleaning solution that is actually needed is used.

In another advantageous embodiment of the invention, the cap membrane in the chamber cap has a control section, which can be seen through a viewing window in said cap during the contact lens chamber filling process. The purpose of said control section is to allow for verification that the lenses are being cleaned in the desired fashion. The cap-membrane control section becomes visible in the cap viewing window when a contact lens chamber is filled with a defined amount of cleaning solution, thus indicating to the user that the contact lens chamber is sufficiently full—and thus that the contact lens is completely wetted with cleaning solution.

This function can also provide information regarding the status of the device's service life, in that if the desired display fails to appear in the viewing window it can be assumed that the case does not contain sufficient cleaning solution and therefore needs to be replaced.

An advantage of this embodiment is that the cap-membrane control section can constitute a recess in the cap membrane, wherein said recess faces the chamber cap. This in turn allows for better regulation of the display in the viewing window in that the control section exhibits a clearly defined form and thus can also be precisely positioned in the small viewing window. In addition, the extent of cap-membrane deformation and the path back to the viewing window are can be reduced and defined.

In another advantageous embodiment of the invention, the fluid reservoir is composed of an upper bowl containing a minimum of one contact lens chamber, as well as a lower bowl that is attached to the upper bowl via a watertight seal, whereby the enclosed interstitial space is filled with cleaning solution. Advantageously, upper cup also accommodates the requisite pump, and thus only the lower bowl need exhibit a bowl-like shape. In the process envisaged here, the entire enclosed space between the cups is filled with cleaning solution in such a way that the maximum amount of fluid can be accommodated, thus lengthening the service life of the invention.

In order to avoid a vacuum in a fluid reservoir thus realized, the lower bowl has a flexible sealing membrane that covers all or most of the surface of said bowl and is attached thereto in such a way that said bowl's vent openings, which face the inside of the fluid reservoir, are sealed off. Thus when fluid is removed from the fluid reservoir during the pump-induced surge, the consequent vacuum is nonetheless offset by deformation of the sealing membrane. Consequently this membrane becomes increasingly deformed relative to the upper bowl over the course of the device's service life, thus allowing air to enter the lower bowl via the vent openings, whereby said lower bowl is isolated from the fluid reservoir by the elastic sealing membrane. This mechanism ensures that the pump-induced surge is reliably achieved at all times.

In an advantageous embodiment of the invention, the sealing membrane covers all or most of the surface of the lower bowl and engirdles the joint between the upper and lower bowls, thus making said joint a watertight seal. Hence the sealing membrane is realized in the manner of an interstitial layer between the upper and lower bowls and is fixed, via the bowl joint, to the circumferential joint area using (for example) a circumferential plug-and-socket connector on the bowls. Owing to its elasticity, the sealing membrane thus attached between the bowls also creates a seal in this joint area, whereby said seal is necessary in order to prevent fluid leakage from said joint.

In the interest of making the chamber caps optimally easy to open and close, they can be attached to the upper bowl via a unilateral hinge and can be opened and closed via a snap-in mechanism. The hinge mechanism on the casing ensures that the cap cannot go astray as a separate element and that the cap is guided into its correct closed position and cannot, for example, become a small element that is skewed in the chamber opening. The advantage of a snap-in mechanism is that the chamber can be closed by simply pressing the cap into its snap-in position. The cap can then be reopened by simply pressing on it, thus releasing the snap-in mechanism.

In addition, the closed chamber can be advantageously protected against adventitious opening by attaching a safety strap to the side of each upper bowl via a hinge. When a cap is closed, said strap extends across it and is immobilized, thus preventing pressure-induced adventitious opening of the cap.

The fluid flows out of the fluid reservoir into the two contact lens chambers through a minimum of one check valve, which establishes a connection between the pump and the said two chambers.

The fluid reservoir should hold enough fluid for several weeks of use. This saves the user the trouble of manually filling the contact lens chambers with fluid from another container; instead, filling is realized by simply pressing a button.

The invention will be better understood, and other advantages and characteristics which it exhibits will emerge better on reading the description which follows, made with reference to the attached drawings, in which.

Figure 1:
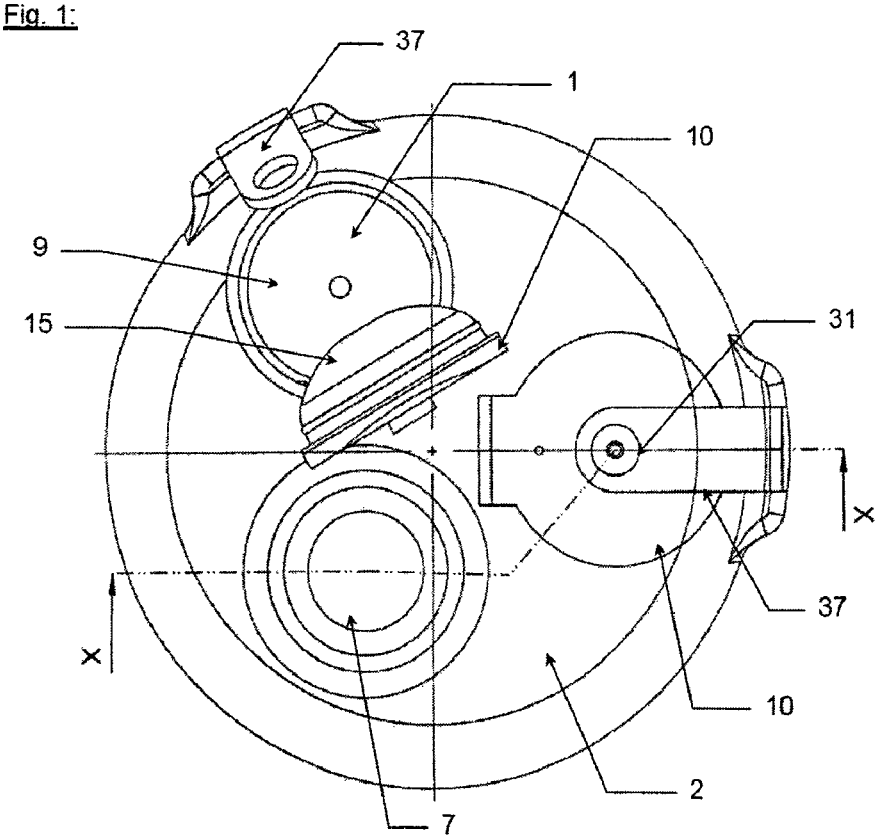
FIG. 1 shows a top view of a contact lens storage and cleaning case
Figure 2:
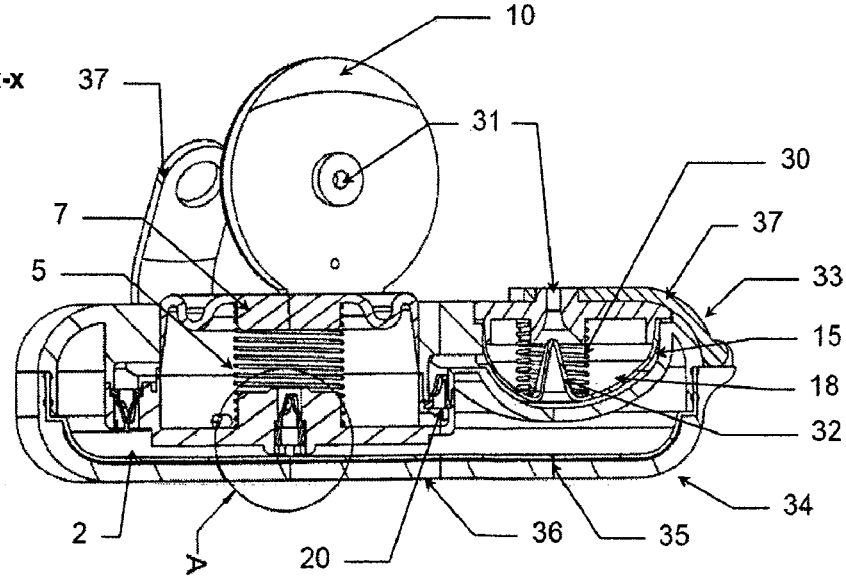
FIG. 2 shows a cross-section of a contact lens chamber and the contact lens storage and cleaning case pump
Figure 3:
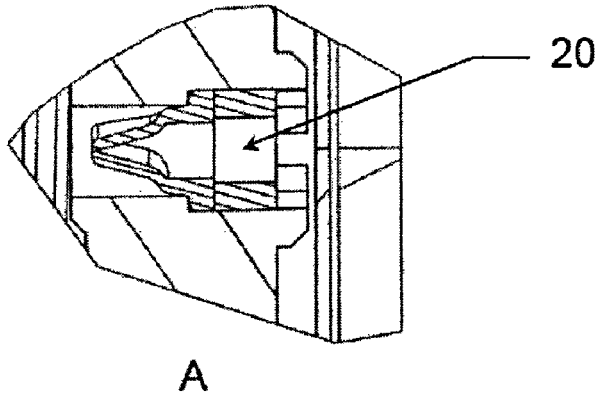
FIG. 3 shows a detail of a check valve
Figure 4:
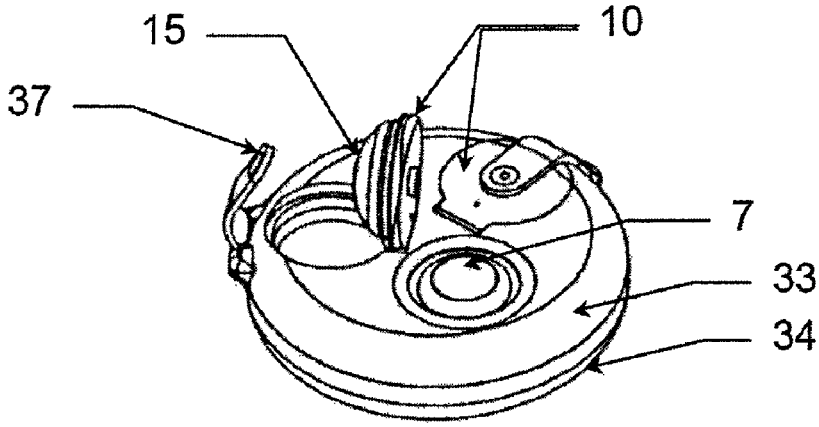
FIG. 4 shows a perspective view of a contact lens storage and cleaning case

The contact lens storage and cleaning case comprises the following components:

Contact lens chambers 1 for the contact lenses

Chamber caps 10

Fluid reservoir 2

Pump 7 to transport the cleaning solution from the fluid reservoir to the contact lens chambers The device should preferably be realized in a design that is practical, easy to handle and readily transportable. One viable realization of the device is considered to be the wafer rotation ellipsoid described herein, which is 25 mm thick and 80 mm in diameter.

The device is composed of two main elements:

1. Contact lens chambers 1
2. Fluid reservoirs 2

The pump, which is a fixed component of the contact lens storage and cleaning case, is mounted in the upper bowl 33 of the device along with the two contact lens chambers 1.

Each of the two contact lens chambers 1 can be closed in a watertight manner using a hinged cap 10. In the design described here, this chamber cap 10 is attached to the middle of the upper bowl via a hinge. To ensure that said cap 10 (which advantageously can be opened and closed via a snap-in mechanism) does not open adventitiously, a safety strap 37 is provided that extends across said cap 10 and engages with a form-fitting end-position notch in a projecting element on the chamber cap 10.

The contact lens chambers 1 and fluid reservoir 2, which comprise a single unit, preferably should jointly create a symmetrical, thin, flat and easy to handle form. The lower bowl 34 on the fluid reservoir 2 has an impermeable elastic sealing membrane 35 that engirdles the vent openings 36 facing the cleaning solution in the lower bowl 34; said membrane adapts itself to surge-induced volumetric changes in the cleaning solution and isolates said fluid from the air entering the contact lens storage and cleaning case via said openings.

Pumping fluid out of the fluid reservoir 2 causes the sealing membrane 35 to contract, thus ensuring that only fluid will be pumped out, regardless of the current orientation of the device. Even if fluid is pumped out in any position desired (e.g. from overhead), only fluid—and no air—is pumped into the contact lens chambers. Hence the lower bowl 34 of the contact lens storage and cleaning case is composed of two layers: a hard, perforated outer hull; and a flexible sealing membrane 35.

After all cleaning solution has been pumped out, the sealing membrane ends up lying on the inner bowl of the upper bowl 33 of the contact lens storage and cleaning case. In this case, the now empty interior space of the contact lens storage and cleaning case would be filled with air, whereupon (depending on the embodiment) a disposable case can be disposed of, a reusable case can be refilled, or a new fluid reservoir containing cleaning solution can be mounted.

The external airflow into the contact lens storage and cleaning case resulting from the vacuum engendered by the surge occurs through the integrated openings 36 and offsets the vacuum. This in turn allows for concurrent airflow-volume reduction and ambient-air isolation, thus (a) avoiding any admixing of air and fluid components; and (b) ensuring that the device will have a long service life and that only fluid—and no air—will enter the contact lens chambers.

The contact lens chambers 1 are connected to the fluid reservoir 2 via either a shared check valve 20 or a check valve 20 for each chamber.

A pump 7 transports fluid from the fluid reservoir 2 to the contact lens chambers 1. Said pump comprises a pump button which, when activated by the user, slides the appropriate pistons into the appropriate cylinder, thus transporting the cleaning solution out of the cylinder chamber. Said fluid is conducted from the cylinder chamber to the contact lens chambers 1 via suitable connecting channels.

The pump cylinder returns to its starting position either via a recoil spring 5 in the cylinder chamber or via a rubber or other elastic connection between the pump button and the surrounding enclosure.

The chamber caps 10 have essentially the same structure as the fluid reservoir in that they are partially rigid (e.g. made of plastic) and partially flexible (e.g. made of rubber). A flexible cap membrane 25 creates a cavity 18 inside the chamber cap 10.

When fluid is transported from the fluid reservoir 2 to the contact lens chambers 1, the cap membrane 15 expands. This in turn forces air out of the cavity 18 through small openings in the top of the chamber cap 10. When a chamber cap is opened to remove a contact lens, the elasticity of the cap membrane 15 and/or the recoil action of the spring causes said membrane to return to its original position, with the result that ambient air is again drawn into the cavity 18 through the cap openings.

The contact lens chamber caps 10 are partially or completely transparent, thus allowing the user to check the fluid level in the contact lens chambers after filling them. Advantageously, during the filling process a control section 32 comprising a moving cap membrane can be viewed through a viewing window 31 in the chamber cap, thus readily allowing the user to check the contact lens chamber 1 filling level. Likewise advantageously, this control section can be realized as a cap membrane 15 recess facing the chamber cap 10, whereby said section appears in the viewing window when the membrane is deformed, thus indicating the filling level of the contact lens chambers.

The contact lenses 9 are removed via the opening in the chamber cap 10, whereupon the used fluid in the contact lens chambers 1 is simply disposed of in the customary manner. Inasmuch as check valves need elevated pressure in order for fluid to pass through them, when a chamber cap 10 is open no fluid can leak out of the pump chamber into the contact lens chambers 1. Fluid is transported from the fluid reservoir 2 to the contact lens chambers 1 only when the pump 7 is activated.

The disposable contact lens storage and cleaning case is replaced after all of the fluid stored in it has been used. When this occurs, owing to the permanent vacuum resulting from the absence of fluid flow in the pump chamber, the pump button can no longer return to its original position and will thus remain depressed.

Figure 5:
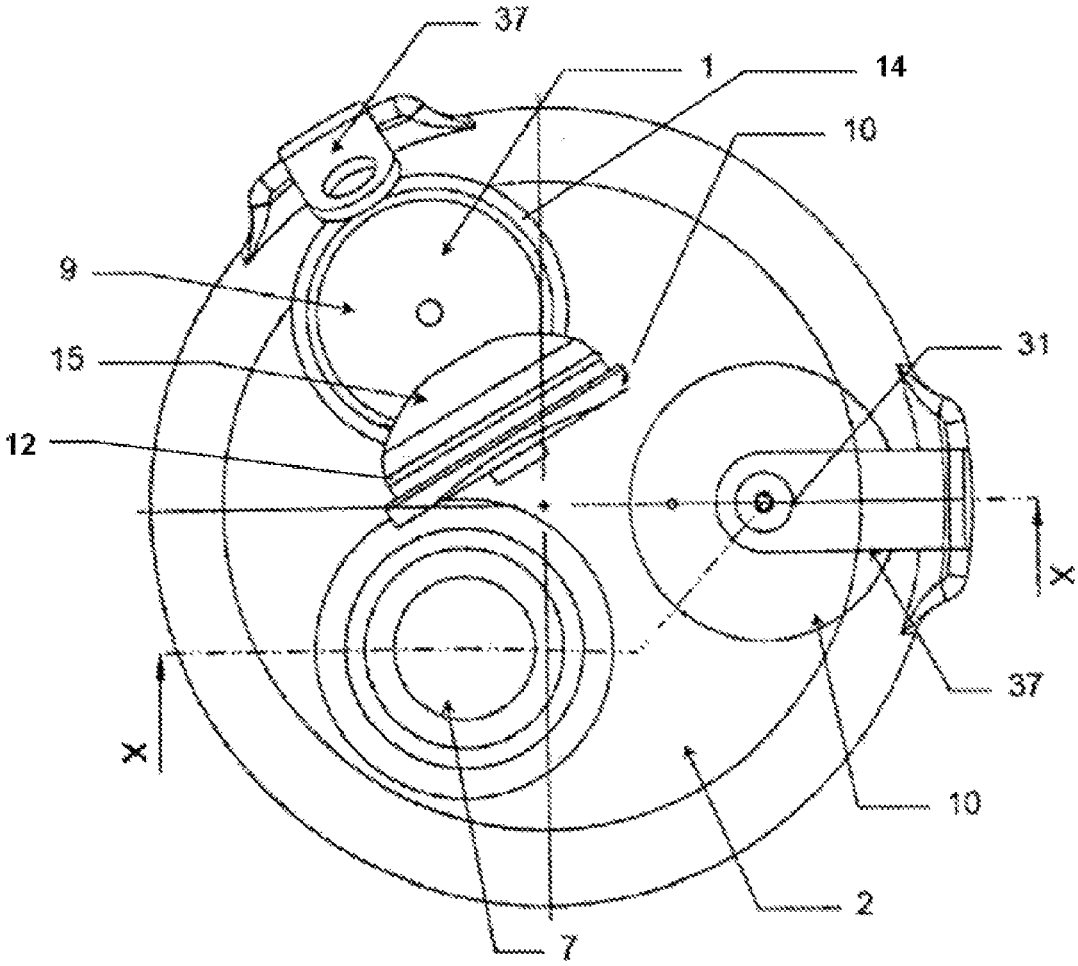
FIG. 5 shows a top view of a contact lens storage and cleaning case with screw-on caps.

In at least one embodiment depicted in FIG. 5, the chamber caps 10 are realized as screw-on caps with outer male threads 12 that engage with female threads 14 in the contact lens chambers 1.

The invention, which is intended for use by contact lens wearer who care for and store their lenses via the one-stage care system, is the result of integrating a contact lens storage case into a fluid reservoir in such a way that said reservoir and case are directly connected to each other and are separated solely by a regulable valve. The contact lens chambers 1 can be filled with fluid from the fluid reservoir 2 by simply pressing a pump button 7 that is integrated into the device, whereupon a pump-induced pressure surge causes the partitioning valve 20 that connects the fluid reservoir 2 and contact lens chambers to open. This in turn allows fluid from the fluid reservoir 2 to be transported irreversibly to the contact lens chambers 1.

The uniqueness of the present invention lies in the fact that contact lens wearers will only need a single device to store and care for their contact lenses 9, and that said device is extremely easy to use and transport. Moreover, the pushbutton contact lens chamber filling process is easier and more convenient than any existing method. In addition, the present invention makes it impossible for a user to leave behind one system element (i.e. either the storage case or the cleaning case) as both elements are integrated into a single device.

Thanks to its flat and narrow shape, and small size, the user can carry the device in any manner and to any location desired (e.g. in a trousers pocket, to a sports activity, or on an airline flight), thus providing the user with more comfort and mobility than is afforded by currently available devices.

The invention claimed is:

1. A contact lens storage and cleaning case comprising:
two removable chamber caps;
two contact lens chambers each for storing a contact lens; and
a minimum of one fluid reservoir and integrated pump,
wherein the contact lens chambers are closable by using the removable chamber caps each of which has a flexible compressible cavity in whose center is mounted a flexible cap membrane that faces and isolates said chamber; whereby air can escape from said cavity via an opening in the chamber cap; wherein the cap membrane comprises a chamber cap control section that becomes visible through a viewing window in the chamber cap when the corresponding contact lens chamber is filled.

2. The contact lens storage and cleaning case according to claim 1, wherein the cap membrane is tensioned against the contact lens chamber by a resilient mount provided in the compressible cavity.

3. The contact lens storage and cleaning case according to claim 1, wherein the chamber cap control section is a recess in the cap membrane that faces that chamber cap.

4. The contact lens storage and cleaning case according to claim 1, wherein the contact lens chambers caps comprise a hinged cap that snaps into the body of the cleaning casing.

5. The contact lens storage and cleaning case according to claim 1, wherein the fluid reservoir comprises
an upper bowl containing the contact lens chambers at a minimum; and
a lower bowl attached to the upper bowl via a watertight joint, whereby the resulting enclosed interstitial space is fillable with cleaning solution.

6. The contact lens storage and cleaning case according to claim 5, further comprising a flexible sealing membrane mounted on all or most of the surface of the lower bowl and is thus attached to the upper bowl, in such a way that the inside of the fluid reservoir creates a seal relative to vent openings in the lower bowl.

7. The contact lens storage and cleaning case according to claim 6, wherein the flexible sealing membrane that covers all or most of the surface of the lower bowl goes all the way around the joint between the upper and lower bowls, thus making said joint a watertight seal.

8. The contact lens storage and cleaning case according to claim 5, wherein the chamber caps are attached to the upper bowl via a unilateral hinge and can be opened and closed via a snap-in mechanism.

9. The contact lens storage and cleaning case according to claim 1, wherein the chamber caps are realized as screw-on caps with outer male threads that engage with female threads in the corresponding contact lens chambers.

10. The contact lens storage and cleaning case according to claim 5, wherein when closed, the chamber caps are safeguarded against adventitious opening by safety straps that are attached to the side of the upper bowl via hinges.

11. A contact lens storage and cleaning system comprising:
a case comprising:
two contact lens chambers each for storing a contact lens therein; and
at least one fluid reservoir and integrated pump; and
one or more removable chamber caps corresponding to the lens chambers, each cap defining a flexible compressible cavity in whose center is mounted a flexible cap membrane facing and isolating the corresponding chamber when the cap is mounted on the chamber, each cap having an opening for the release of air from said cavity, wherein the cap membrane comprises a chamber cap control section that becomes visible through a viewing window in the chamber cap when the corresponding contact lens chamber is filled.

* * * * *